US006142261A

United States Patent [19]

Yang

[11] Patent Number: 6,142,261

[45] Date of Patent: Nov. 7, 2000

[54] REVERSE-PREVENTING STRUCTURE FOR A BABY WALKER

[76] Inventor: Peng-Yao Yang, No. 561, Sec. 4, An Ho Road, Tainan, Taiwan

[21] Appl. No.: 09/167,727

[22] Filed: Oct. 7, 1998

[51] Int. Cl.[7] ..... B62B 9/08; B60B 33/00

[52] U.S. Cl. ..... 188/20; 280/87.051

[58] Field of Search ..... 188/1.12, 19, 20, 188/31; 267/5; 280/33.994, 642, 647, 650, 87.051

[56] References Cited

U.S. PATENT DOCUMENTS

| | | | |
|---|---|---|---|
| 4,618,033 | 10/1986 | Kassai | 188/20 |
| 4,953,667 | 9/1990 | Bigo | 188/31 |
| 5,617,934 | 4/1997 | Yang | 188/1.12 |
| 5,632,360 | 5/1997 | Melara | 188/1.12 |
| 5,785,154 | 7/1998 | Chen | 188/1.12 |
| 5,813,681 | 9/1998 | Saint et al. | 280/87.051 |

*Primary Examiner*—Christopher P. Schwartz
*Attorney, Agent, or Firm*—Rosenberg, Klein & Lee

[57] ABSTRACT

A reverse-prevent structure for a baby walker includes several slide-preventing strips, a moving wheel and a reverse-preventing wheel. The characteristic of the present invention lies in the reverse-preventing wheel, which is composed by an inner tray and an outer casing. The inner tray is fixed and has an inwardly protrudent annulus. The annulus is provided with a angle-shaped hollow for a movable catch block to be placed in. The movable catch block is provided to interact with the ratchets encircling the inner wall of the outer casing. When the outer casing is rolling forward, the ratchets successively slide over the movable catch block, and the outer casing can advance smoothly. If the outer casing rolls in the reverse direction, one of the ratchets will be stopped by the movable catch block immediately, and the catch portion of the movable catch block will be caught in the notch between two ratchets. Therefore, the outer casing as well as the reverse-preventing wheel will be prevented from rolling in the direction.

1 Claim, 8 Drawing Sheets

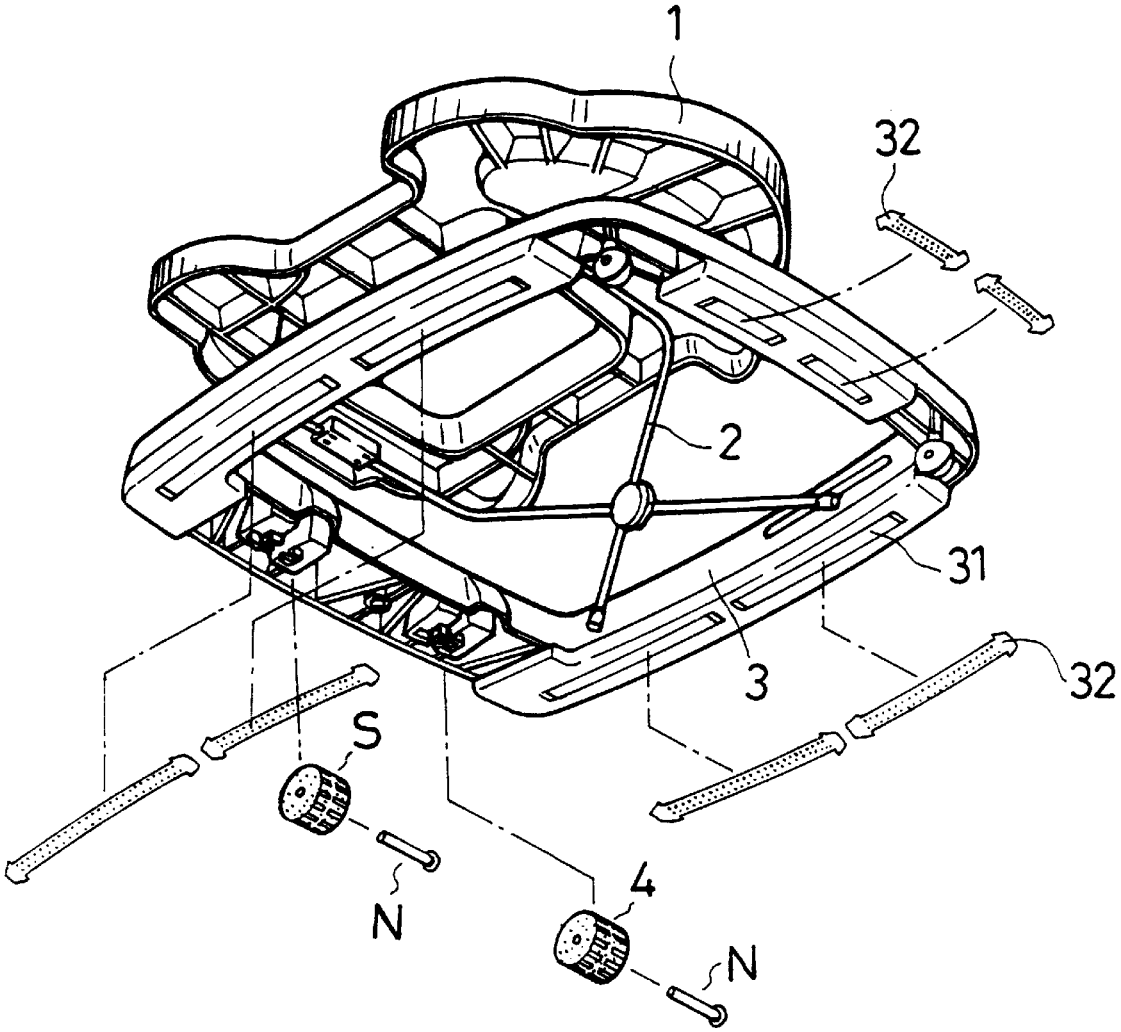
FIG.4
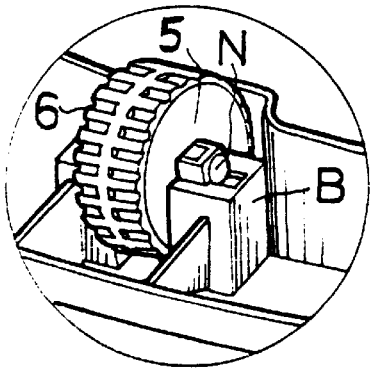
FIG.4-A

REVERSE-PREVENTING STRUCTURE FOR A BABY WALKER

BACKGROUND OF THE INVENTION

1. Field of the Invention

This invention relates to a reverse-preventing structure for a baby walker, more particularly to a reverse-preventing structure which can prevent a baby walker from moving on the reverse suddenly so as to effectively avoid dangers and to ensure the safety of the baby in the baby walker.

2. Description of the Related Art

Previously, a baby walker is simply provided with several wheels in the bottom of the lower frame. While a baby in the walker moves around as pleased, because the baby does not have good sensitivity to the dangers of the surroundings and does not have good distinction of distance, something attractive would cause the baby to move near to a staircase or other dangerous places. The baby would walk on the reverse suddenly and happen to fall downstairs or bump against a wall or furniture so as to be frightened and even hurt. In many countries, the kind of baby walkers are forbidden to be manufactured and sold. Therefore, reverse-preventing structures are continually invented to overcome the above-mentioned drawback of a baby walker.

Referring to FIG. 1, a conventional reverse-preventing wheel device 100 is usually provided in the bottom of the lower frame of a baby walker.

The conventional wheel device 100 is composed by a wheel 10, a pivot article 20 and a board 30. The wheel 10 and the board 30 are combined by the pivot article 20. On the board 30 is provided with an inserting rod 301 protruding upward. On the inner side of the board 30 is provided with a catch 50 by a pin 40 so that the catch 50 can interact with the flanged ratchets 101 on the inner side of the wheel 10. On the outer side of the wheel 10 is provided with a board 102 having an inserting rod 1021 protruding upward. The inserting rods 1021 and 301 are both inserted into the bottom of the lower frame of a baby walker.

Referring to FIG. 2, while a baby in the baby walker walks on the level ground, the wheel 10 will roll forward smoothly, and the ratchets 101 are successively slide over the catch 50 without resistance. If the wheel 10 rolls on the reverse, the ratchets 101 will be stopped by the catch 50 so as to prevent the wheel 10 from rolling on the reverse.

When being used, the above-mentioned conventional wheel device also has following drawbacks:

1. The wheel device is composed by a lot of parts because it is additionally provided with two inserting rods on two boards on both sides of the wheel in order to be fixed in the bottom of the lower frame; therefore, it costs much, wastes time in composing and does not have beautiful outlook.

2. The catch will not have the effect of reverse-preventing because of break, split or transformation after use in a period of time.

3. Referring to FIG. 3, while a baby in the baby walker walks up to a slope, the catch will deviate from its normal position toward outside because of the influence of the slope. Consequently, both the ratchets and the catch do not function in case of the wheel rolling forward or on the reverse; that is, the wheel device can not prevent the baby walker from moving on the reverse and does not have the effect of fixing the walker while being up to a slope.

SUMMARY OF THE INVENTION

In view of the drawbacks of the prior art mentioned above, an objective of the present invention is to provide a reverse-preventing structure for a baby walker which can prevent a baby walker from moving on the reverse while on the level ground or up to a slope so as to ensure the safety of the baby in the baby walker.

Another objective of the present invention is to provide a reverse-preventing structure which is provided in the interior of a wheel without any additional part provided on its appearance so that it is easy to be composed, saves cost and time in composing and has beautiful outlook.

A further objective of the present invention is to provide a reverse-preventing structure whose catch block will not lose efficacy after use for a long time.

Accordingly, a reverse-preventing structure for a baby walker in the present invention includes several slide-preventing strips, a moving wheel and a reverse-preventing wheel. The characteristic of the present invention lies in the reverse-preventing wheel, which is composed by an inner tray and an outer casing. The inner tray is fixed and has an inwardly prudent annulus. The annulus is provided with a angled-shaped hollow for a movable catch block to be placed in. The movable catch block is provided to interact with the ratchets encircling the inner wall of the outer casing. When the outer casing is rolling forward, the ratchets successively slide over the movable catch block, and the outer casing can advance smoothly. If the outer casing rolls on the reverse, one of the ratchets will be stopped by the movable catch block immediately, and the catch portion of the movable catch block will be caught in the notch between two ratchets. Therefore, the outer casing as well as the reverse-preventing wheel will be prevented from rolling on the reverse.

BRIEF DESCRIPTION OF THE DRAWINGS

Other features and advantages of the present invention will become apparent in the following detailed description of the preferred embodiments with reference to the accompanying drawings, in which:

FIG. 4 is an exploded perspective view showing a reverse-preventing structure in the present invention how to be provided in the bottom of the lower frame of a baby walker;

FIG. 4A is an enlarged perspective view showing the condition of the reverse-preventing wheel in the present invention provided in the bottom of the lower frame of a baby walker;

DETAILED DESCRIPTION OF THE PREFERRED EMBODIMENTS

Figure 1:
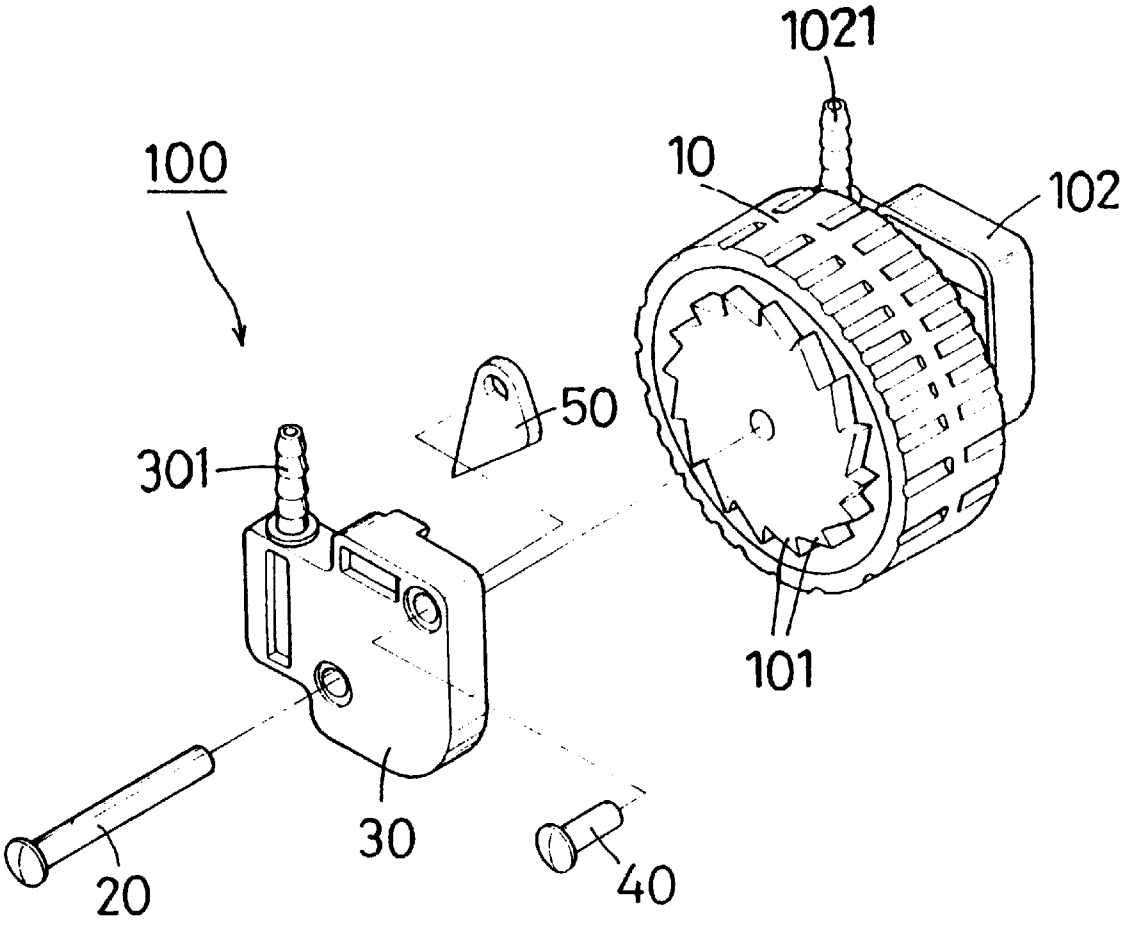
FIG. 1 (PRIOR ART)
FIG. 1 is an exploded perspective view of a conventional wheel device.
Figure 2:
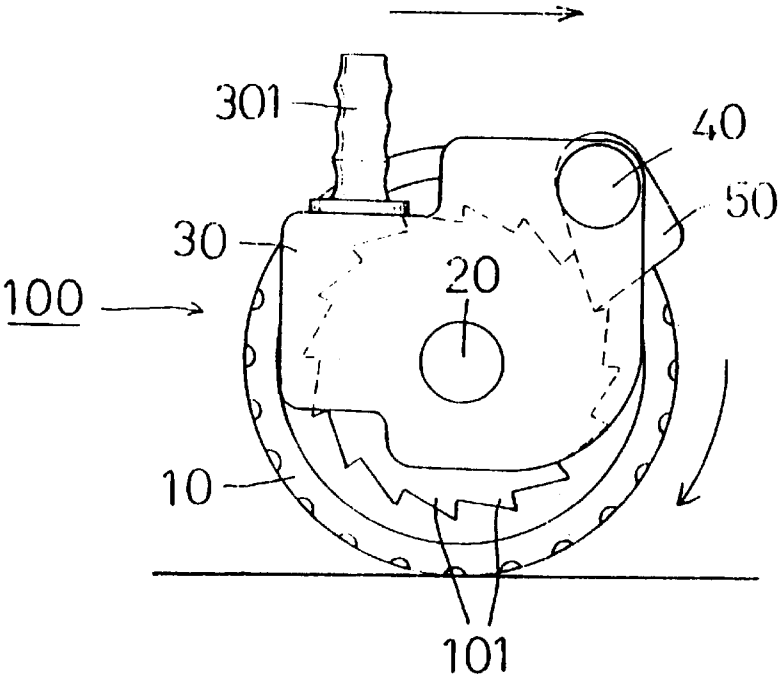
FIG. 2 (PRIOR ART)
FIG. 2 is a schematic view of a conventional wheel device moving on the level ground.
Figure 3:
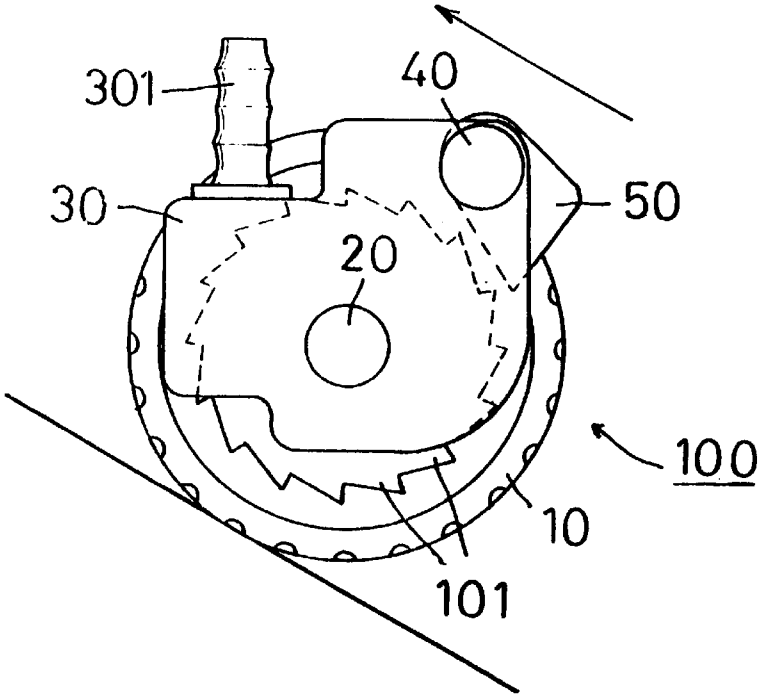
FIG. 3 (PRIOR ART)
FIG. 3 is a schematic view of a conventional wheel device moving up to a slope.

Referring to FIG. 4, a baby walker in the present invention is composed by an upper plate 1, a supporting skeleton 2, a lower frame 3, several slide-preventing strips 32, a moving wheel 4, a reverse-preventing wheel S and several universal wheels. The supporting skeleton 2 is provided to connect the upper plate 1 and the lower frame 3 so as to support and adjust the height of the upper plate 1. The slide-preventing strips 32 are respectively provided in the hollows 31 in the bottom of the lower frame 3. The moving wheel 4, the reverse-preventing wheel S and several universal wheels are respectively provided in the proper positions of the bottom of the lower frame 3 so as to make the baby walker move around and for a baby to learn to walk while sitting in the baby walker.

Figure 5:
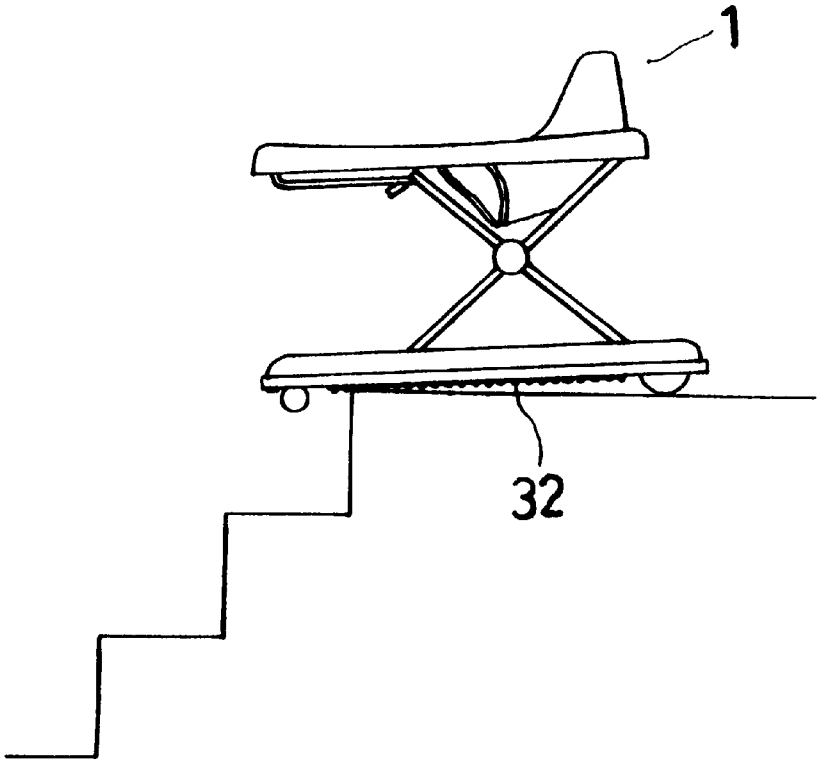
FIG. 5 is a schematic view showing a baby walker being stopped from sliding downstairs by the slide-preventing strips in the present invention.
Figure 6:
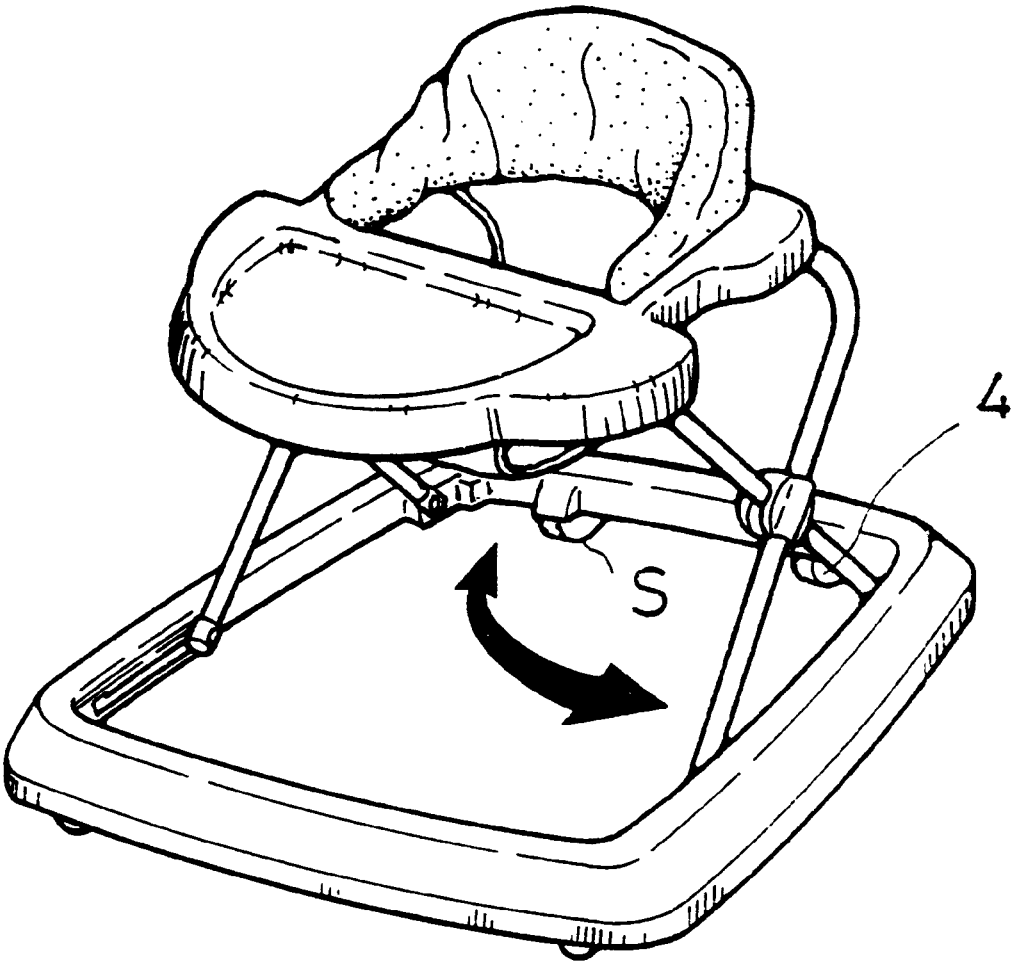
FIG. 6 is a schematic view showing the direction of a baby walker is adjustable by the moving wheel while the baby walker being stopped from moving on the reverse in the present invention.

Referring to FIG. 5, when a baby walker should happen to slide near a staircase, the slide-preventing strips 32 can stop the baby walker from sliding downstairs in time. While the baby walker moves on the reverse, the reverse-preventing wheel S will prevent the baby walker from moving on the reverse, and the moving wheel 4 can function to adjust the direction of the baby walker to another way to avoid the obstacle behind, as shown in FIG. 6.

Figure 7:
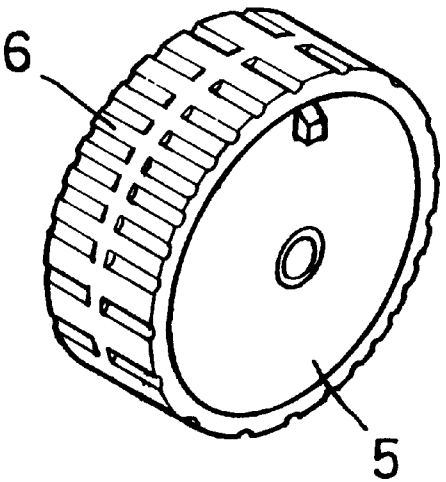
FIG. 7 is a combined perspective view of the reverse-preventing wheel in the present invention.

The characteristic of the present invention lies in the reverse-preventing wheel S, which is composed by an inner tray 5 and an outer casing 6, as shown in FIG. 7. The reverse-preventing wheel S is inserted into the groove formed between two opposite wheel support bases B provided in the rear portion of the bottom of the lower frame 3, as shown in FIG. 4-A. Then a fixing pin N penetrates successively through the hole in the upper portion of one of the opposite wheel support bases B, the central long hole of the reverse-preventing wheel S and the hole of the other wheel support base B so as to fix the inner tray 5 of the reverse-preventing wheel S in the bottom of the lower frame 3. Thus, the outer casing 6 can roll because its axle is pivoted in the central hole of the inner tray 5.

The moving wheel 4 is provided in one proper position near the reverse-preventing wheel S and has the similar composing parts and manner to those of the reverse-preventing wheel S. The difference is that there is no reverse-preventing device in the moving wheel 4.

Figure 8:
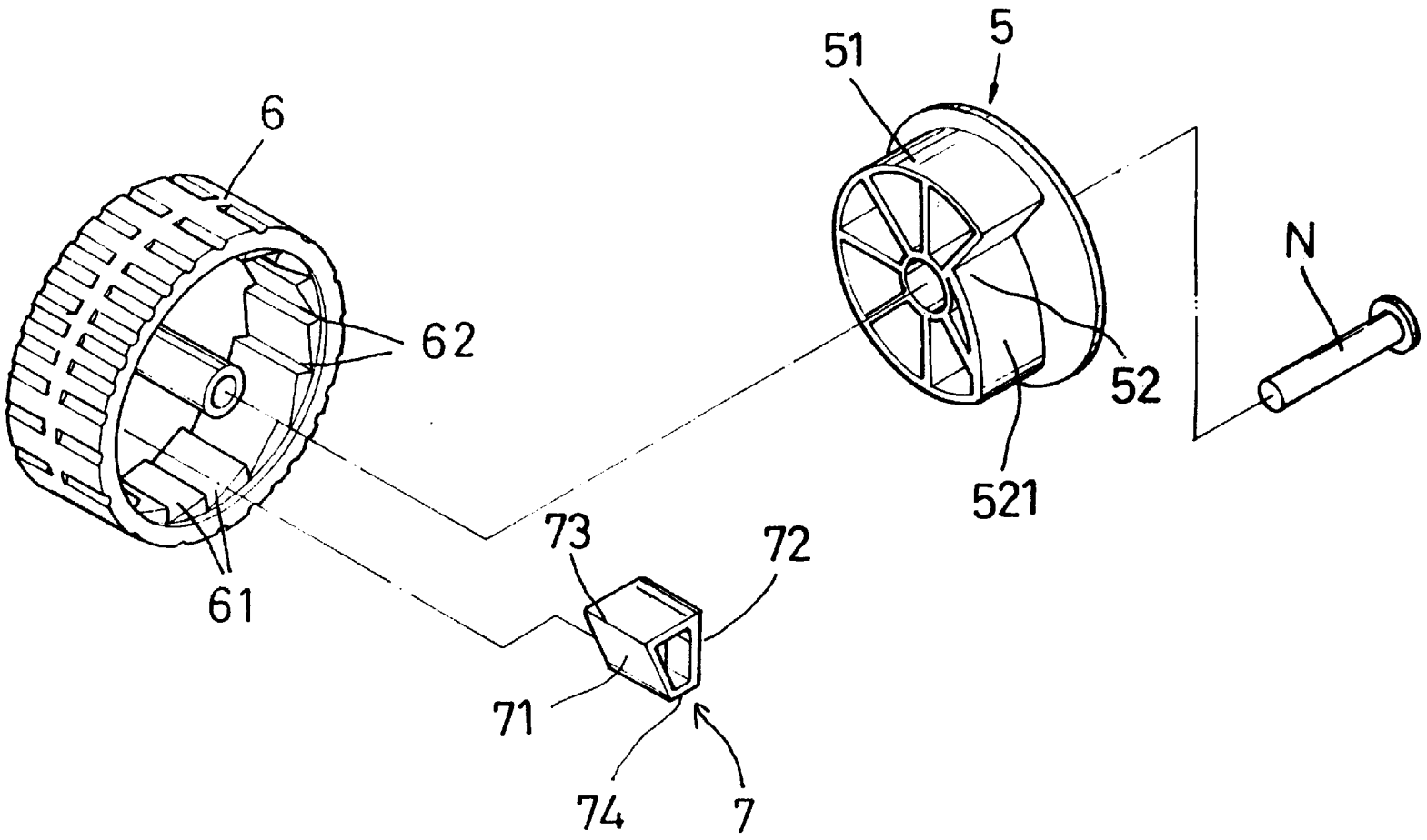
FIG. 8 is an exploded perspective view of the reverse-preventing wheel in the present invention.

Referring to FIG. 8, on the inner side of the inner tray 5 is protrudently provided with an annulus 51. The annulus 51 has a properly sized angled-shaped hollow 52 for a movable catch block 7 to be placed in. The angled-shaped hollow 52 is provided with an arch portion 521. A long hole is provided in the center of the inner tray 5. A plurality of ratchets 61 are provided encircling the inner wall of the outer casing 6, and the notches 62 are formed between the ratchets 61. An inwardly protrudent and hollow axle is provided in the center of the outer casing 6 so as to be inserted into the central long hole of the inner tray 5 and then for the fixing pin N to penetrate through. The movable catch block 7 is trapezoid; its bigger slant surface is an outer stopping portion 71; its smaller slant surface is an inner against portion 72; the angle between the outer stopping portion 71 and its top surface is a catch portion 73; its bottom surface is an action portion 74.

Figure 10:
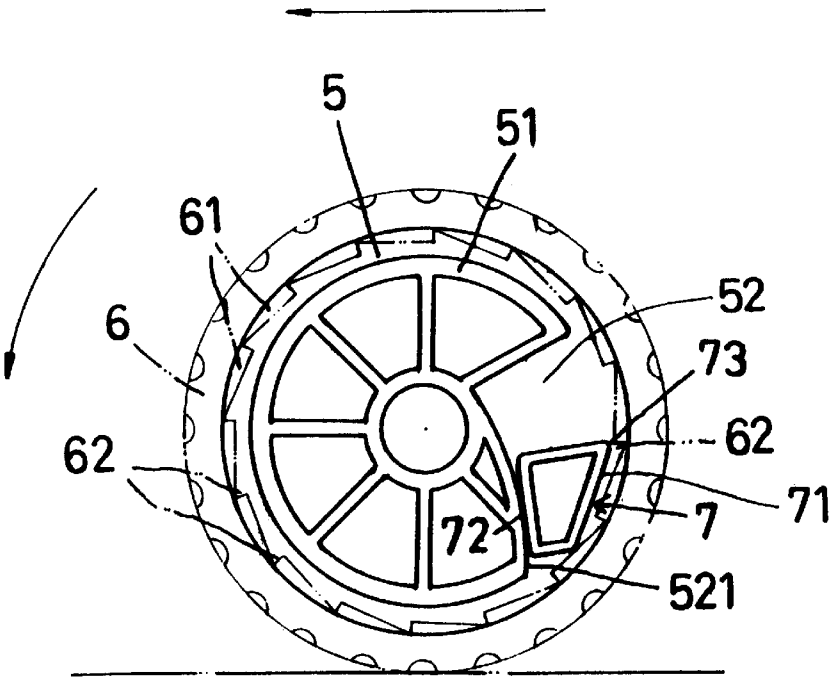
FIG. 10 is a left-side schematic view showing the reverse-preventing wheel rolling forward in the present invention.
Figure 9:
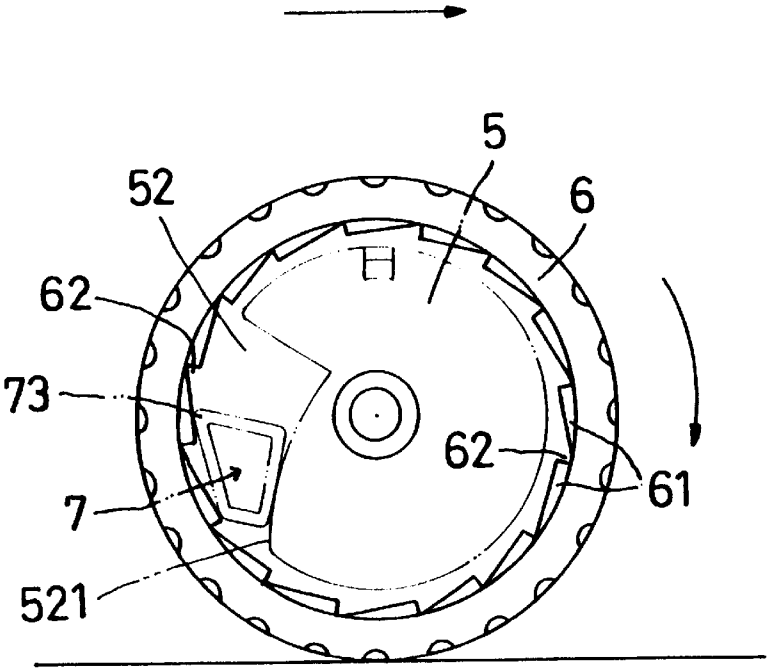
FIG. 9 is a right-side schematic view showing the reverse-preventing wheel rolling forward in the present invention.

Referring to FIGS. 9 and 10, while the reverse-preventing wheel S is rolling forward, the ratchets 6Y1 of the outer casing 6 successively slide over the movable catch block 7 and touch the action portion 74 so that the movable catch block 7 is jumping up and down.

Figure 11:
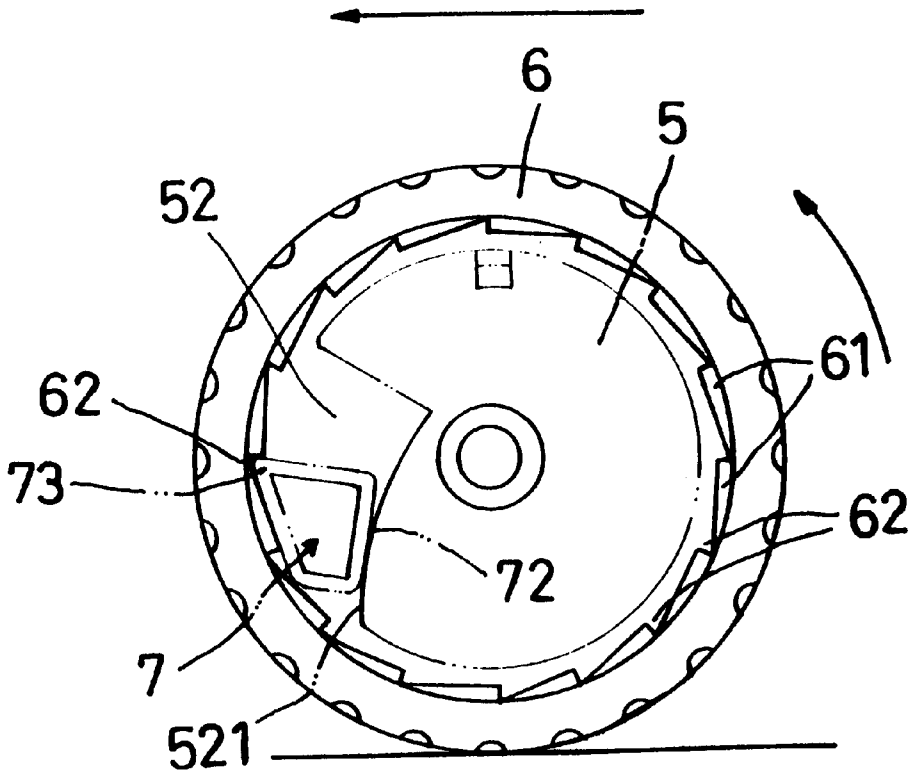
FIG. 11 is a schematic view showing one of the ratchets being stopped by the movable catch block when the outer casing rolling on the reverse in the present invention.

Referring to FIG. 11, when the reverse-preventing wheel S rolls on the reverse, the movable catch block 7 will still fall down as usual because it is a freely falling body, one of the notches 62 of the ratchets 61 will be stopped and caught firmly by the catch portion 73 immediately, and the bottom portion of the movable catch block 7 will be caught in the space between the arch portion 521 and the ratchets 61 so as to stop the outer casing 6 and prevent the reverse-preventing wheel S from rolling on the reverse.

While a baby in a baby walker, which is provided with the above-mentioned structure in the present invention, should happen to slide near a staircase, the slide-preventing strips can stop the baby walker from sliding downstairs in time. While the baby walker moves on the reverse, the reverse-preventing wheel will prevent the baby walker from moving on the reverse, and the moving wheel can function to adjust the direction of the baby walker to another way to avoid the obstacle behind. Accordingly, the reverse-preventing structure in the present invention has the effect of preventing a baby in the baby walker from being frightened or hurt and can ensure the baby's safety.

While the preferred embodiments of the invention have been described above, it will be recognized and understood that various modifications may be made therein and the appended claims are intended to cover all such modifications which may fall within the spirit and scope of the invention.

What is claimed is:

1. A reverse-preventing structure for a baby walker comprising a reverse preventing wheel for mounting between a pair of spaced wheel support bases of a lower baby walker frame, said reverse preventing wheel including:

an inner tray adapted to be affixed to a respective one of the wheel support bases, said inner tray having an opening formed centrally therein and a protruding annulus extending from a side thereof, said annulus having a substantially angularly-shaped recess formed therein, said recess having a an arched portion;

a movable catch block disposed in said recess and having a trapezoidal shape; and, an outer casing having an axle extending from a central portion thereof inserted into said opening of said inner tray for rotatably mounting said outer casing to said inner tray, said outer casing having an annular wall substantially concentrically overlaying said annulus of said inner tray and a plurality of ratchet teeth encircling an inner surface of said annular wall, said movable catch block having a longer inclined side disposed adjacent said ratchet teeth, whereby said outer casing freely rotates relative to said inner tray in a first direction and rotation of said outer casing in an opposing second direction is prevented by said movable catch block becoming lodged between said arched portion of said recess and a respective one of said ratchet teeth.

* * * * *